US006382006B1

(12) United States Patent
Field et al.

(10) Patent No.: US 6,382,006 B1
(45) Date of Patent: May 7, 2002

(54) REMOVABLE CYLINDRICAL LOCK CORE

(75) Inventors: Peter H. Field; W. Daniel Boadwine, both of Salem, VA (US)

(73) Assignee: Medeco Security Lock, Inc., Salem, VA (US)

( * ) Notice: Subject to any disclaimer, the term of this patent is extended or adjusted under 35 U.S.C. 154(b) by 0 days.

(21) Appl. No.: 09/537,299

(22) Filed: Mar. 29, 2000

(51) Int. Cl.[7] ..... E05B 9/04
(52) U.S. Cl. ..... 70/371; 70/369
(58) Field of Search ..... 70/369, 371, 367, 70/368, 340

(56) References Cited

U.S. PATENT DOCUMENTS

| | | | | | |
|---|---|---|---|---|---|
| 3,324,693 | A | * | 6/1967 | Check | 70/369 |
| 3,603,123 | A | * | 9/1971 | Best | 70/369 X |
| 3,667,264 | A | * | 6/1972 | Surko, Jr. et al. | 70/369 |
| 3,713,311 | A | * | 1/1973 | Oliver et al. | 70/369 |
| 4,294,093 | A | * | 10/1981 | Best et al. | 70/369 |
| 4,328,690 | A | * | 5/1982 | Oliver | 70/369 |
| 4,386,510 | A | * | 6/1983 | Best et al. | 70/369 |
| 4,424,693 | A | * | 1/1984 | Best et al. | 70/369 |
| 4,444,034 | A | * | 4/1984 | Best et al. | 70/369 |
| 5,070,715 | A | | 12/1991 | Smallegan et al. | 70/369 |
| 5,421,179 | A | * | 6/1995 | Bergström | 70/369 |
| 5,507,163 | A | * | 4/1996 | Juang | 70/369 |

FOREIGN PATENT DOCUMENTS

| | | | | |
|---|---|---|---|---|
| FR | 839222 | * | 6/1939 | 70/369 |
| NO | 35783 | * | 9/1922 | 70/371 |

* cited by examiner

*Primary Examiner*—Lloyd A. Gall
(74) *Attorney, Agent, or Firm*—Rothwell, Figg, Ernst & Manbeck

(57) ABSTRACT

A shell and core interchangeable lock assembly for use in a shell housing. The core includes a rotatable pin plug and the shell includes a substantially cylindrical body with a pin chest therein. A mechanism which captures the shell and core within the shell housing includes an integral retainer ring and lug which is attached to the core. The mechanism allows rapid insertion and removal of the shell and core by the use of a correctly bitted control key. The mechanism additionally has a sub-mechanism for preventing its operation by accident or by tampering without the appropriate control key.

10 Claims, 4 Drawing Sheets

REMOVABLE CYLINDRICAL LOCK CORE

FIELD OF THE INVENTION

The present invention relates generally to mechanical locks, and more particularly, to shell and core lock assemblies that are removable from a shell lock housing mounted on a wall of an enclosure.

BACKGROUND OF THE INVENTION

A variety of mechanical locks are known, including locks to secure dwellings, buildings, vehicles, compartments, access hatches, gates, etc. Mechanical locks typically have a rotatable core plug containing a key slot. The insertion of a correctly-bitted key displaces tumbler pins within the lock, thereby allowing the core plug to rotate. The rotation of the core plug actuates an locking bolt or the like that locks or unlocks the structure or enclosure that the lock is a part of. If the key is not a correctly-bitted key, either the key will not be able to fully enter the slot, or the lock will not be allowed to rotate.

"Shell and core" lock assemblies are known in the art wherein the lock components include separate cylindrical shells and cores that can together be installed with a housing into a wall of an enclosure. Improvements upon such shell and core lock assemblies have made the core and shell removable from the shell housing by the use of a special control key so as to facilitate lock replacement or re-keying. In a removable core lock, the core and shell, including the key plug and tumbler pins, can be removed from the lock using the control key while leaving the remaining lock housing in place. A removable shell and core lock offers the advantage of being able to easily and cheaply change the keying of the lock without removing and replacing the entire lock apparatus by simply removing the shell and core, and then fitting the shell with a new core. Removable core locks may be commonly used in numerous applications where the frequent rekeying of locks is anticipated. The advantages include not only a lesser cost in hardware replacement, but also significant time and labor savings.

An exemplary prior art lock having a removable lock core is disclosed in U.S. Pat. No. 5,070,715 to Smallegan et al. The removable shell and core disclosed in Smallegan is locked inside the shell housing using a compound locking pin which is de-activated by the turning of a control key. During normal lock operation, this locking pin is spring biased into locked position such that it protrudes out of the lock core and into a slot in the shell housing such that the core and shell cannot be axially removed from the housing.

Unfortunately, the prior art removable-core locks commonly have a complicated structure whereby the cores and shells are retained in the shell housing by a series of spring-biased tumbler pins or other movable internal retaining devices comprised of multiple parts. When the core is removed from such locks, these retaining devices have an unfortunate propensity for falling out of the lock or becoming unseated from a desired position. Additionally, normal wear and tear, and contamination such as dirt, often makes removable cores and shells having such spring loaded locking mechanisms difficult to install and remove, or even completely non-functional.

Therefore, there remains a need in the art for a shell and core lock assembly that can be sold and delivered as a unit by a manufacturer for incorporation in enclosures, wherein the core can be easily and efficiently removed and replaced without problems of existing removable core devices and with increased strength and durability.

SUMMARY OF THE INVENTION

A shell and core interchangeable lock assembly for use in a shell housing is disclosed. The core comprises a rotatable pin plug and the shell comprises a substantially cylindrical body with a pin chest therein. A mechanism which captures the shell and core within the shell housing comprises an integral retainer ring and lug which is attached to the core. The mechanism allows rapid insertion and removal of the shell and core by the use of a correctly bitted control key. The integral ring and lug construction allows the capturing mechanism to advantageously be controled directly by the rotation of the control key and without multiple spring biasing mechanisms. The mechanism thereby prevents lock operation and core changing by accident or through tampering.

The above and other features, aspects, and advantages of the present invention will be further understood from the following description of the preferred embodiment thereof, taken in conjunction with the accompanying drawings.

DETAILED DESCRIPTION OF THE INVENTION

Figure 1:
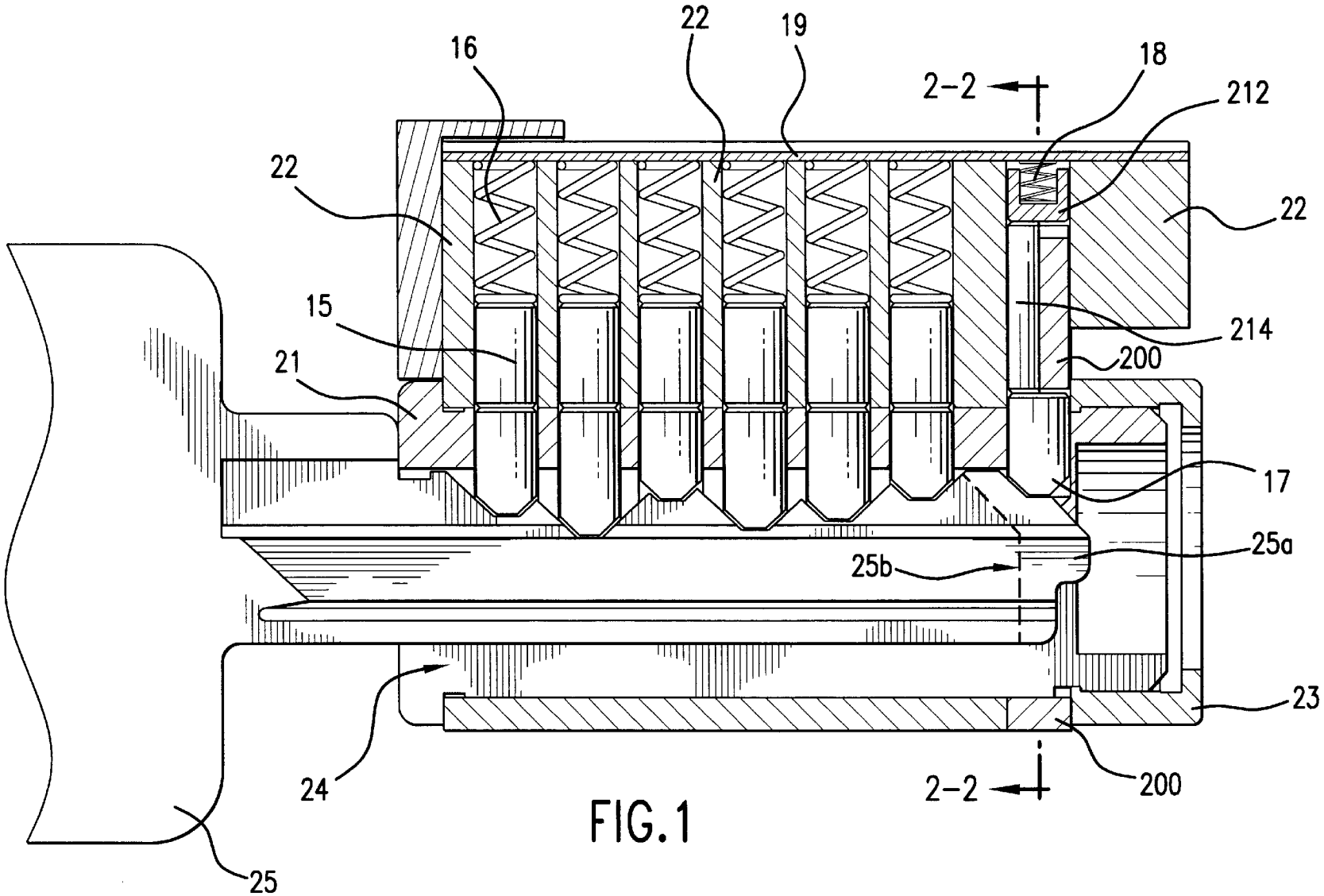
FIG. 1 is a cross-sectional view of a removable core lock according to embodiments of the present invention taken along the plane of the key blade.

FIG. 1 is a cross section of an interchangeable lock core cylinder according to an embodiment of the present invention. The lock shell 22 has an upper portion in which the lock pins 15 and lock pin springs 16 are located, and an attached lower portion which has a cylindrical bore in which the core key plug 21 is co-axially installed. The function and operation of the upper portion of the lock shell 22, namely the pins and tumblers, is well known in the art and will not be further discussed here. Instead, the discussion will focus on the rightmost portion of the FIG. 1 near cross-sectional line 2—2 where the mechanism for locking the shell 22 and core plug 21 within the lock housing 100 (depicted in FIG. 2) is located.

Core plug 21 is inserted into a cylindrical borehole formed in the core shell 22 as is known in the art such that the pins from the core shell 22 and the key plug 21 communicate. A lower control pin l is installed inside the key plug 21 at the far end of the keyway 24. A locking retainer ring 200 is placed on the plug 21 with a retainer ring driving notch 218 on its inside diameter which is aligned with lower control pin 17. Lower control pin 17 additionally is aligned such that it is connected to upper control pin 212 through intermediate control pin 214. All three control pins 212, 214, and 17 are biased downward by control pin spring 18 which is retained in place by spring cover 19. A core plug cap 23 is installed on the end of core 21 after the retainer ring 200 to fix the core 21 within the core shell 22 borehole.

A control key 25 is shown inserted in keyway 24 of the core 21 in FIG. 1. A line 25*b* shown in phantom indicates the point at which a standard key (i.e, a key which merely unlocks the lock) would terminate. The small additional projection 25*a* provided on the distal end of the control key 25 to the right of line 25*b* is the only difference between standard key and control key 25.

Figure 2:
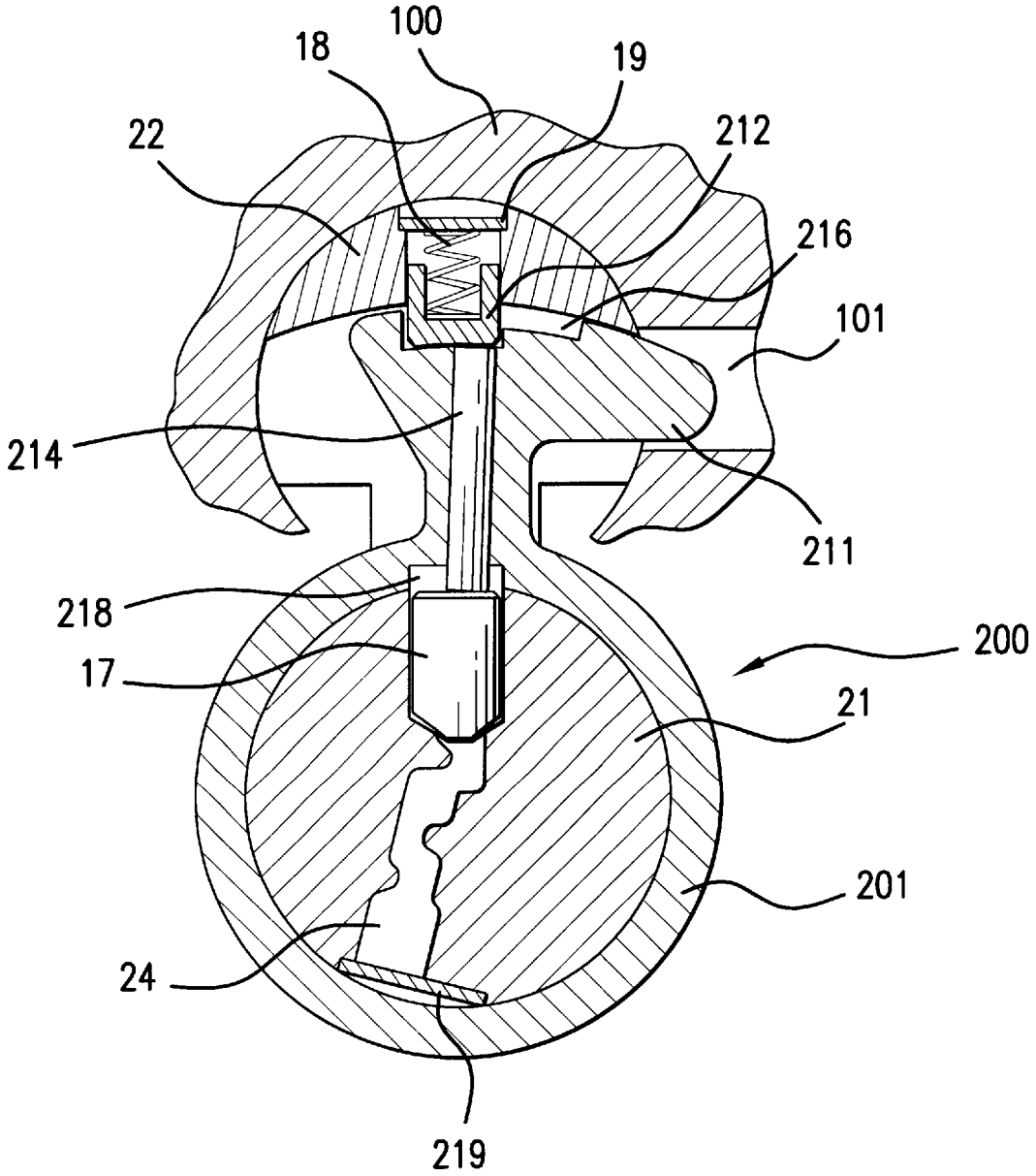
FIG. 2 is a cross sectional view of a removable core lock according to embodiments of the present invention taken perpendicular to the plane of the key blade along line 2—2 from FIG. 1 in the state when a control key is not inserted.

FIG. 2 depicts a cross-sectional view of the core locking mechanism according to one embodiment of the present invention fixed inside a shell housing 100 taken perpendicular to the keyway 24 along cross-sectional line 2—2. In FIG. 2, keyway 24 is empty, meaning that control key 25 is not inserted into the core plug 21. Without a control key 25 inserted fully into keyway 24, lower control pin 17 is biased downward by control pin spring 18 through upper control pin 212 and intermediate control pin 214 such that control pin, 17 fits completely within core 21. Thus, FIG. 2 depicts the situation where either no key is inserted into the keyway 24, or where a standard key (a key having identical bittings to the control key 25, but lacking appendage 25*a*) is being used to unlock the locking mechanism by rotating key plug 21 relative to the shell 22. It will be readily understood by one skilled in the art that in order to allow the unhindered rotation of core 21 relative to locking retainer ring 200 by a standard key, lower control pin 17 and intermediate control pin 214 should meet at a surface which is substantially level with the outer circumference of core 21.

Due to the downward force placed on both the intermediate control pin 214 and upper control pin 212 by spring 18, keyway cover 219 is provided to prevent intermediate control pin 214 from entering keyway 24 during rotation of the core 21 relative to the shell 22 during normal lock operation.

Figure 5:
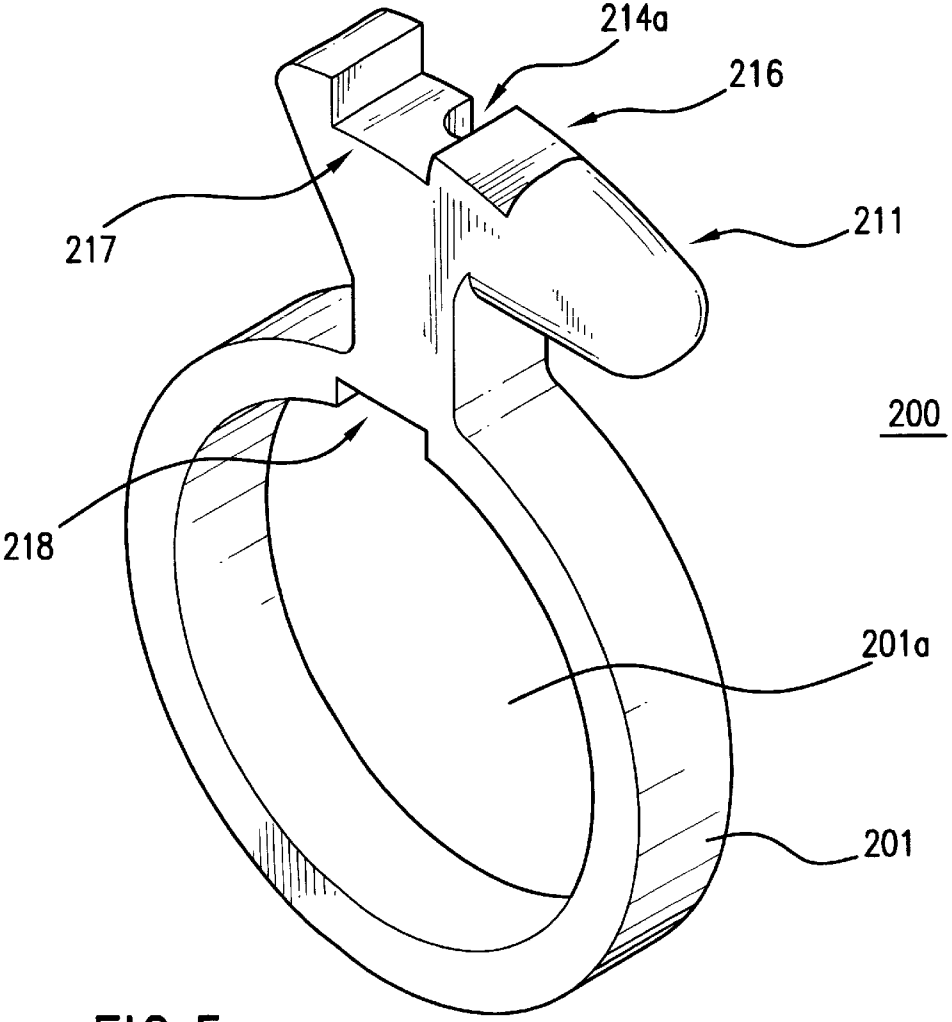
FIG. 5 is a perspective view of a locking retainer ring used in preferred embodiments of the present invention.

Locking retainer ring 200 as depicted cross-sectionally by FIG. 2 and dimensionally by FIG. 5, has a retainer ring sleeve 201 and a retainer ring lug 211. The retainer ring sleeve has a circular aperture 201*a* which is adapted to receive core plug 21 in substantially close contact while still allowing core plug 201 to be freely rotated within the aperture by a correctly standard key.

The retainer lug 211 is a protrusion connected to the retainer ring sleeve 201 which is adapted to fit into a slot 101 formed in the shell housing 100. With lug 211 extending into slot 101 as shown in FIG. 2, both the shell 22 and core 21 are locked in place such that they cannot be withdrawn axially from the shell housing 100.

As shown in the figures, intermediate control pin 214 preferably extends through the body of locking retainer ring 200 through a slot 214*a*. This allows for an integral construction of lug 211 and retainer ring 201 which provides structural strength, while still allowing the vertical displacement of lower control pin 17 to be communicated to upper control pin 212.

Without the insertion of a control key 25, upper control pin 212 is biased downward by spring 18 into retainer ring locking notch 217 (notch 217 being labeled in FIGS. 3–5) formed in the upper surface of lug 211. This prevents the locking retainer ring from rotating due to shear caused by the rotation of core 21 with a standard key, and thus keeps the lug 211 inside slot 101. Therefore, accidental removal of the shell 22 and core 21 without a control key 25 is prevented.

Figure 4:
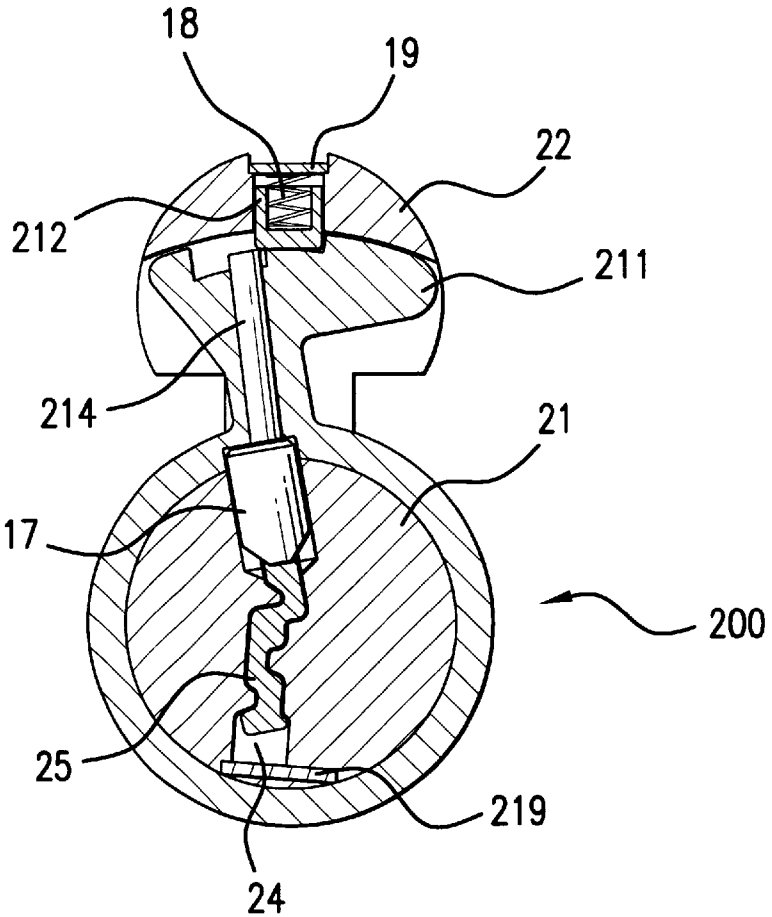
FIG. 4 is a cross sectional view of a removable core lock according to embodiments of the present invention taken perpendicular to the plane of the key blade along line 2—2 from FIG. 1 in the state after a control key is inserted and then rotated.
Figure 3:
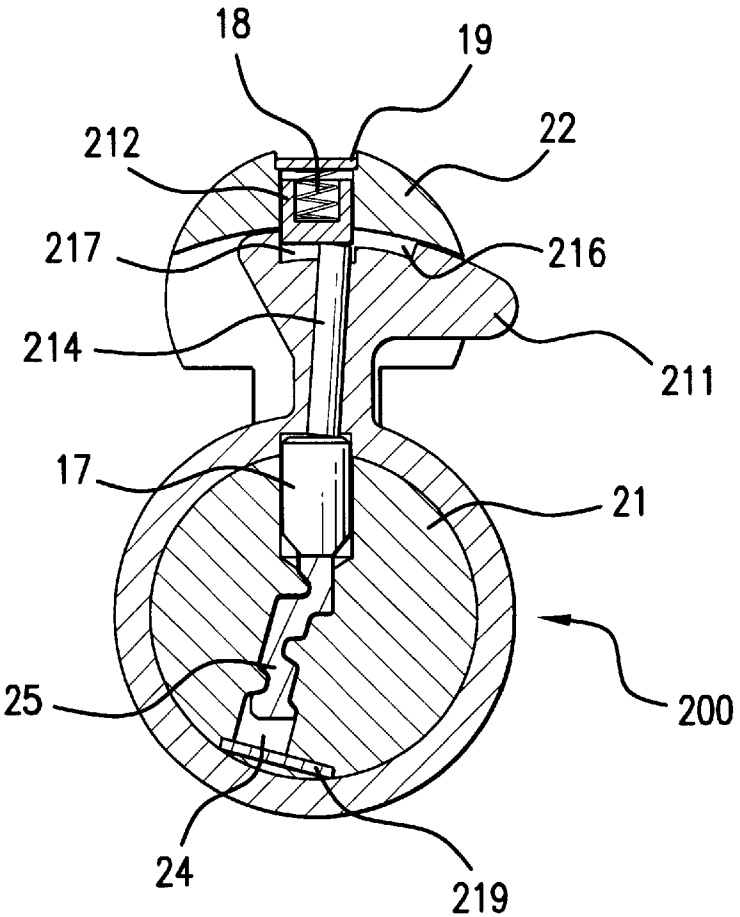
FIG. 3 is a cross sectional view of a removable core lock according to embodiments of the present invention taken perpendicular to the plane of the key blade along line 2—2 from FIG. 1 in the state after a control key is first inserted.

Comparing FIG. 2 collectively to FIGS. 1, 3 and 4, it can be seen that insertion of control key 25 into the keyway 24 of core 21 displaces the lower control pin 17 upward due to the presence of projection 25*a*. This elevation of the control pin 17 forces intermediate control pin 214 and upper control pin 212 upward against the bias provided by spring 18. As shown by FIG. 3, this upward displacement is large enough to move upper control pin 212 completely out of the locking notch 217.

As shown in FIG. 3, the insertion of the control key 25 completely into keyway 24 not only unseats upper control pin 212 from locking notch 217, but also simultaneously moves lower control pin 17 upward into retainer ring driving notch 218 formed on the inside circumference of retainer ring sleeve 201. With lower control pin 17 thus engaging the retainer ring driving notch 218, the core 21 can no longer be rotated without simultaneously rotating retainer sleeve 201 and thereby laterally moving lug 211.

From the position depicted in FIG. 3, the control key can be rotated so as to disengage lug 211 from slot 101, as depicted in FIG. 4. It can be seen by comparison of FIGS. 3 and 4 that rotation of the control key by only a few degrees is necessary to move lug 211 from the secured position in FIG. 3 to the installation position in FIG. 4. This small degree of rotation is controlled by the abutment of upper control pin 212 with the opposing lateral walls of locking notch 217 and rotation stop notch 216 formed on the upper surface of lug 211. Once the control key 25 has been rotated to the installation position, the control key 25, core 21, and shell can be slid axially from the shell housing 100.

It will be apparent to one skilled in the art that once shell and core have been removed, a new core can be installed into the lock housing such that different keys are required to open the lock. This can achieved either by installing a completely different shell and core pair, or by fitting a new core into the removed shell in place of the old core and then installing them into the housing.

After a new shell and core pair has been axially slid into the housing (status depicted by FIG. 4), the control key 25 is rotated from its installation position to its secured position (status depicted in FIG. 3). This rotation causes lug 211 to engage slot 101, and allows control key 25 to be removed from keyway 24. When control key 25 is withdrawn, lower control pin 17, intermediate control pin 214, and upper control pin 212 all move downward due to the biasing force of spring 18 (status depicted in FIG. 2). In this manner, upper control pin 212 returns to engagement with locking notch 217 such that locking retainer ring 200 is again prevented from rotating with core 21 due to shear forces.

Accordingly, with the present invention a shell, core, and shell housing assembly can be delivered to an installation location for an enclosure. The shell, core, and shell housing can be attached to the enclosure such that the shell and core are removably retained in the enclosure. The shell and core can be removed as described hereinabove so as to quickly and easily re-key the lock for the enclosure. The shell and core of the present invention also has an improved engagement mechanism with the housing such that it not only avoids the use of multiple movable parts, but also provides an improved and durable engagement member that can be easily manufactured and can be handled without substantial risk of damage, etc., that could potentially interfere with operation.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. A lock, comprising:

a shell having tumbler pins and a substantially cylindrical borehole;

a substantially cylindrical core plug received coaxially within said borehole of said shell, said core plug being rotatable in said shell and having tumbler pins which engage tumbler pins of said shell, said core plug further having a key slot;

a shell housing for removably receiving said shell and said core plug, said housing having a slot; and a retainer ring which secures said core plug and said shell within said housing, said retainer ring comprising a lug and a sleeve formed integral to each other, said sleeve being substantially circular and coaxially engaging said core plug, said lug securing said core plug and shell axially within said housing by engaging said slot, said lug being moveable into and out of engagement with said slot by rotation of said sleeve, said sleeve including a driving notch and said lug including a locking notch;

said retainer ring including an upper control pin engageable with said locking notch and with a bore in said shell, and a lower control pin engageable with said driving notch, and having a transverse bore containing an intermediate control pin, said intermediate control pin being contacted by said lower control pin to engage said upper control pin;

wherein said retainer ring has a secure position and an install position, such that when said retainer ring is in said secure position said sleeve is prevented from being rotated by said core plug by virtue of said lower control pin being disengaged from said driving notch, and said lug is in engagement with said slot and is prevented from disengagement with said slot by virtue of said upper control pin being engaged with said locking notch, and when said retainer ring is in said install position said sleeve rotates with said core plug by virtue of said lower control pin being engaged with said driving notch and said upper control pin is disengaged with said locking notch, whereby said lug is disengaged with said slot such that said core plug and said shell can be axially withdrawn from said housing, and wherein the insertion and rotation of a control key in said key slot of said core plug moves said lower control pin to thereby move said retainer ring between said secure position and said install position.

2. The lock of claim 1, wherein the insertion of said control key locks said sleeve to said core plug and simultaneously unlocks said lug such that said sleeve rotates with said core plug as said control key is turned.

3. The removable core lock of claim 2, wherein said lug moves transversely relative to said core plug upon rotation of a control key.

4. The lock of claim 1, wherein during lock use with said retainer ring in said secure position, said core plug rotates freely within said shell and said sleeve with a standard key having proper bittings.

5. The lock of claim 1, wherein said lug has a substantially conical shape.

6. The lock of claim 1, wherein with said retainer ring in said install position, said core plug and said shell can be axially withdrawn from said housing.

7. An interchangeable lock assembly for use with a lock housing comprising:

a shell having a series of tumbler pins and a substantially cylindrical borehole;

a substantially cylindrical core plug rotatably inserted within said borehole, said core plug having a keyway adapted to receive a plurality of keys;

at least one control pin, said control pin being displaced by the insertion of a control key into said keyway; and a retainer ring having a substantially circular aperture and a lug, said core plug coaxially passing through said aperture, and said lug having a locking notch engageable with a locking control pin to lock said lug in position with respect to said shell;

wherein the displacement of said control pin by said control key causes said control pin to interact with said locking control pin to disengage from said locking notch so as to free said lug such that it is moved laterally into and out of a retaining slot in said housing with the rotation of said core plug.

8. The interchangeable lock assembly according to claim 7, wherein said retainer ring comprises a sleeve integrally formed with said lug.

9. The interchangeable lock assembly according to claim 7, wherein when said control key is not inserted in said keyway said at least one control pin disengages with said locking control pin to lock said lug in said retaining slot during rotation of said core plug by causing said locking control pin to engage with said locking notch.

10. The interchangeable lock assembly according to claim 7, wherein said lug has a substantially conical shape.

* * * * *